US006250934B1

(12) United States Patent
Eskildsen et al.

(10) Patent No.: US 6,250,934 B1
(45) **Date of Patent: *Jun. 26, 2001**

(54) IC PACKAGE WITH QUICK CONNECT FEATURE

(75) Inventors: Steven R. Eskildsen, Folsom; Jeffrey C. Franz, El Dorado Hills; David S. Brannam, Cameron Park, all of CA (US)

(73) Assignee: Intel Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/103,241

(22) Filed: Jun. 23, 1998

(51) Int. Cl.[7] ..... H01R 12/00
(52) U.S. Cl. ..... 439/71; 361/737
(58) Field of Search ..... 439/71, 70, 946; 361/736, 737, 752, 753, 759, 801, 802

(56) References Cited

U.S. PATENT DOCUMENTS

| | | | | |
|---|---|---|---|---|
| 4,538,864 | * | 9/1985 | Ichimura | 439/71 |
| 4,695,925 | | 9/1987 | Kodai et al. | 361/395 |
| 4,780,793 | | 10/1988 | Ohtsuki | 361/399 |
| 4,838,804 | | 6/1989 | Banjo et al. | 439/325 |
| 4,868,714 | | 9/1989 | Banjo et al. | 361/395 |
| 4,918,513 | * | 4/1990 | Kurose et al. | 439/71 |
| 4,926,034 | | 5/1990 | Banjo et al. | 235/492 |
| 4,936,784 | * | 6/1990 | Saito | 439/71 |
| 5,073,117 | * | 12/1991 | Malhi et al. | 439/71 |
| 5,437,041 | | 7/1995 | Wakabayashi et al. | 395/800 |
| 5,476,387 | | 12/1995 | Ramey et al. | 439/76.1 |
| 5,659,459 | | 8/1997 | Wakabayashi et al. | 361/753 |
| 5,661,634 | | 8/1997 | Obata et al. | 361/684 |
| 5,735,040 | | 4/1998 | Ochi et al. | 29/841 |

* cited by examiner

*Primary Examiner*—Tulsidas Patel
(74) *Attorney, Agent, or Firm*—Blakely, Sokoloff, Taylor & Zafman LLP

(57) ABSTRACT

An apparatus and method allowing the leads of an integrated circuit (IC) package to provide the electrical interface between an IC die housed within the IC package and a card connector of an IC card that is to be inserted into a host data processing system. The present invention comprises an IC package housed within a card casing to form an IC card, with the leads from the IC package providing the electrical interface between the IC card connector and the IC package. The IC card connector then provides the electrical interface between the IC card and the data processing system. The present invention eliminates a need for both a printed circuit board (PCB) and the soldering step of coupling the IC package to the PCB.

3 Claims, 11 Drawing Sheets

IC PACKAGE WITH QUICK CONNECT FEATURE

RELATED APPLICATION

The present invention is related to the U.S. patent application entitled "IC package with Edge Connect Contacts", Ser. No. 09/103,110, and filed on Jun. 23, 1998.

BACKGROUND OF THE INVENTION

1. Field of the Invention

The present invention relates to the field of integrated circuits, and more particularly, to a method and apparatus for improved interconnections between an integrated circuit and a data processing system.

2. Description of the Related Art

Integrated circuit (IC) cards (also referred to as electronic function cards) are used with data processing systems to provide increased functionality for the data processing system. IC cards may be used for many purposes such as providing additional memory with a memory card or providing digital storage for such applications as cameras and mobile telephones. IC cards may also provide communication capabilities for a data processing system with external data processing systems or networks by functioning as a modem card, a facsimile card, a local area network (LAN) interface card, and/or a multimedia interface card. The IC cards provide convenience for users in allowing the user to install as needed or desired additional capabilities or features for the data processing system.

IC cards are generally portable cards, often referred to as small form factor cards, that may be inserted into and detached from a receptacle within the data processing system. The small form factor card dimensions are designed to correspond with the particular receptacle into which they will be inserted. Although leads may be soldered between the card and the data processing system, more typically the card has a connector built in and the card is inserted into a receptacle of the host data processing system (also referred to as a host socket). Once inserted into the receptacle of the data processing system, an electrical interface is made between the card connector and the data processing system allowing for communication between the card components and the data processing system.

The IC card itself generally contains a printed circuit board (PCB) attached to a connector, which serves as the IC card connector, with an IC package then mounted on the PCB. Metallized lines on the PCB allow communication between the IC package and the card connector. In electrically connecting the IC package to the PCB, there are typically two levels of interconnection involved. First, an IC die is enclosed within an insulating housing that includes a lead frame having a plurality of leads extending externally from the housing to form an IC package. The leads may be either pins extending from the housing or bump leads on the surface of the housing. The leads are internally coupled to the IC die and permit the IC die, now encased within the housing, to couple to and communicate with other devices. The second level of interconnection provides an electrical connection of the IC package and connector to the PCB.

There are different methods of coupling the IC package to the PCB. One standard method, referred to as surface mount technology (SMT), is typically used with a thin small outline package (TSOP). With SMT, the TSOP leads are directly soldered to the PCB. The leads must be placed at the desired location on the PCB and then soldered to the PCB. The coplanarity between the leads and the PCB must be tight, and the location of the leads on the PCB must be accurate. Even with robotics performing the soldering process, the time and expense necessary to ensure a workable interconnection between the IC package and the PCB is great.

When soldering an IC package to a PCB, there is a substantial amount of testing required due to the multiple steps involved in assembling the IC card. First, there is a wafer level test on the IC die. Then, after the IC die has been encased in a housing to form an IC package, the connection between the IC die and the leads of the IC package must be checked. Once the IC package and connector are mounted on the PCB, the connections between the leads on the IC package and connector and the metallized lines of the PCB are tested to ensure that nothing was damaged in the soldering process. After the PCB and the IC package and connector mounted thereon are encased in a card casing to form an IC card, the IC card is tested to ensure a workable electrical interface between the components on the PCB and the receptacle of the data processing system. Often, the tests of the connection between the IC package and connector and the PCB and the final IC card product may be done simultaneously in a single step. Thus, as many as four separate testing phases may be required to ensure that the IC die can effectively communicate with the data processing system.

The present invention describes an IC card that eliminates the PCB entirely by allowing the leads from the IC package to serve as the electrical interface between the IC package and the card connector, which is now independent of the PCB. Because a PCB is no longer required to make the connection between the IC package and the data processing system, the manufacturing step of soldering the IC package on to the PCB is eliminated. By eliminating the need for soldering the IC package to the PCB, less material will be used, fewer leads will be damaged, and time will be saved during assembly. Additionally, eliminating the interconnection of the IC package to the PCB eliminates a testing step also. Thus, the elimination of the PCB within the IC card improves the IC card's reliability while simultaneously decreasing both the expense and time associated with assembling the IC card.

SUMMARY OF THE INVENTION

The present invention describes an integrated circuit (IC) card and a method of assembling the IC card. The IC card of the present invention comprises an IC package having multiple leads extending from the package. The IC package is encased within a card casing having a card connector such that the leads from the IC package provide the electrical interface between the card connector and the IC package, without the use of a printed circuit board (PCB). The card connector then provides the electrical interface between the IC card and the data processing system.

The present invention eliminates the need for a PCB to provide an interconnection between the IC package and the card connector. The elimination of the PCB greatly reduces the complexity of the assembly of an IC card by eliminating surface mount technology (SMT) or hand soldering. Additionally, testing is simplified since the connections from the IC package to the PCB and the PCB to the card connector are eliminated.

DETAILED DESCRIPTION OF THE INVENTION

The following detailed description sets forth several embodiments in accordance with the present invention of an integrated circuit (IC) card allowing the leads from an IC package housed within the card casing to provide the electrical interface between the IC package and the card connector. In the following description, details are set forth such as specific dimensions, IC card applications, configurations, connections, etc., in order to prove a more thorough understanding of the present invention. It will be appreciated by one skilled in the art, however, that the present invention may be practiced without these specific details. In other instances, well-known devices, structures, techniques, etc., have not been described in particular detail so as to not obscure the present invention. Each of the different embodiments of the present invention is discussed as used with a data processing system. Note, however, that each embodiment may be used with other types of data processing devices.

In the prior art, an integrated circuit (IC) card generally contains a printed circuit board (PCB) attached to a connector, which serves as the IC card connector, with an IC package then mounted on the PCB. Metallized lines on the PCB allow communication between the IC package and the card connector. In electrically coupling the IC package to the PCB, there are typically two levels of interconnection involved. First, an IC die is housed within an insulating package that includes a lead frame having a plurality of leads extending externally from the package to form the IC package. The leads may be either lead pins extending from the package or bump leads on the surface of the package. The leads are internally coupled to the IC die and permit the IC die, now encased within the package, to be coupled to other devices. The second level of interconnection provides an electrical connection of the IC package and connector to the PCB and involves soldering the IC package to the PCB. This second level of interconnection accounts for a large portion of the time and cost associated with manufacturing an IC card.

The present invention describes an apparatus and method that eliminates the need for a PCB and the second level of interconnection. Instead of an IC package coupled to a PCB having a connector coupled thereto and housed within a casing to form an IC card, the present invention comprises an IC card allowing the leads of the IC package to directly connect to the IC card connector without the use of a PCB. The elimination of the PCB greatly reduces the complexity of the assembly of an IC card by eliminating the need for surface mount technology (SMT).

Figure 1:
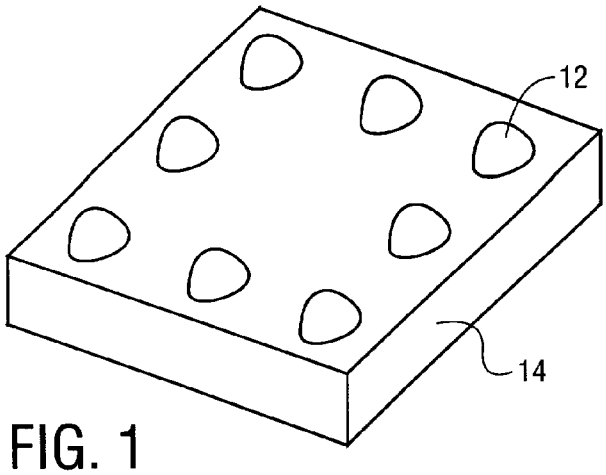
FIG. 1 is a pictorial illustration of an integrated circuit (IC) package with bump leads along the upper surface of the IC package.

FIG. 1 is a pictorial illustration of an IC package with bump leads extending from the IC package. The IC package 10 is comprised of an IC die encased within a housing 14. The IC die is mounted on a lead frame having multiple bump leads 12 located on the surface of the housing 10. The bump leads 12 are connected internally to the IC die leads and extend from the housing 10 to allow the now protected IC die to couple to and communicate with other devices.

Figure 2A:
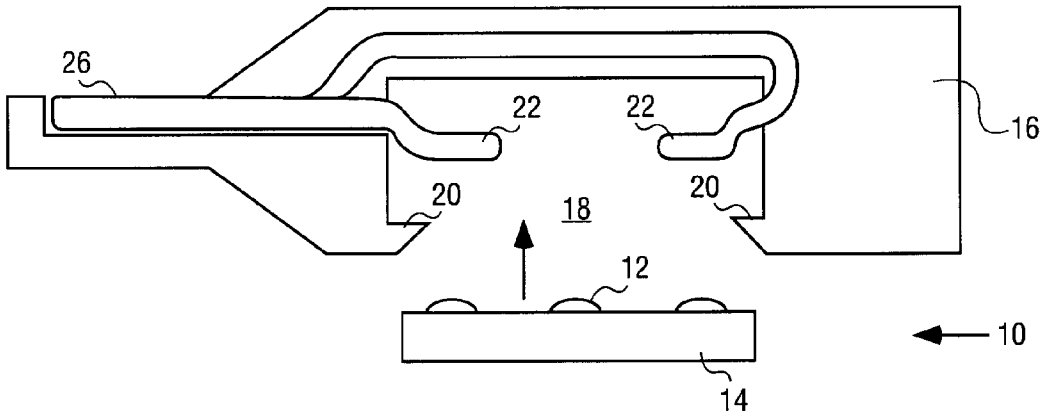
FIG. 2A is a side view of a casing for housing an IC package to form an IC card such that once the IC package is inserted into the casing, the leads from the IC package serve as the electrical interface between the IC card connector and the IC package without the need for a printed circuit board.
Figure 2B:
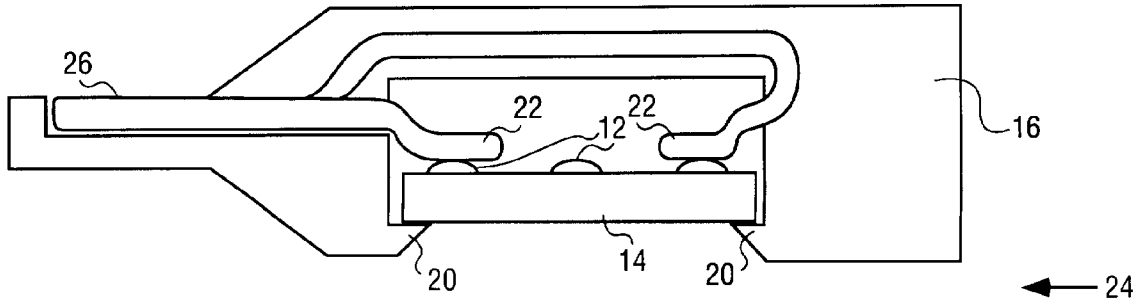
FIG. 2B is a side view of the assembled IC card of FIG. 2A.

FIGS. 2A and 2B are side views of a first embodiment of the present invention. FIG. 2A shows a side view of a casing for housing an IC package to form an IC card such that once the IC package is inserted into the casing, the leads from the IC package serve as the electrical interface between the IC card connector and the IC package without the need for a PCB. FIG. 2B is a side view of the IC card, including the casing with the IC package fully inserted therein.

The IC package 10 (see FIG. 1) is inserted into the casing 16 through the opening 18 on the bottom surface of the casing 16. The stops 20 will encounter the front corners of the housing 14 of the IC package 10. However, as the IC package 10 is inserted into the casing 16, the casing 16 will slightly expand and allow the IC package 10 to be inserted past the stops 20. The IC package 10 is inserted into the casing 16 until the lower surface of the IC package 10 clears the stops 20. Once the IC package 10 is fully inserted into the casing 16, the stops 20 will return to their original position and support the IC package 10 along its lower surface while securely holding the IC package 10 within casing 16. The stops 20 function as snap locks to hold the IC package 10 in place within the casing 16.

As the IC package 10 is inserted into the casing 16, the bump leads 12 will encounter the contacts 22 (also referred to as a connector or connector contacts). The contacts 22 are spring loaded to allow them to provide contact with a variety of IC package tolerances. Once the IC package 10 is inserted into the card casing 16, the connector contacts 22 provide the electrical interface of the assembled IC card 24 with the data processing system along surface 26.

The casing 16 is preferably a single piece of plastic formed from injection molding. As with current form factor cards, the shape and dimensions of the casing 16 may be defined by both the size and shape of the IC package to be housed within the casing and/or the dimensions of the receptacle of the data processing system into which the IC card will be inserted. The casing 16 provides both physical and electrostatic discharge (ESD) protection for the IC package 10 encased therein.

Note also that the card casing 16 of the present invention includes the card connector 22, which resides therein. The integrated casing and connector design of the present invention replaces the former card case and separate connector, typically coupled to a printed circuit board, and provides a cost savings over the prior art in addition to providing a vehicle for quick assembly. The connector may be integrated with the casing in different manners. For example, the casing may be formed around the connector during the injection molding of the casing. Alternatively, the casing could be first formed with injection molding, and the connector later inserted to reside within the casing. If inserted into the casing, the connector will typically have a retention feature to hold it within the casing.

Figure 3A:
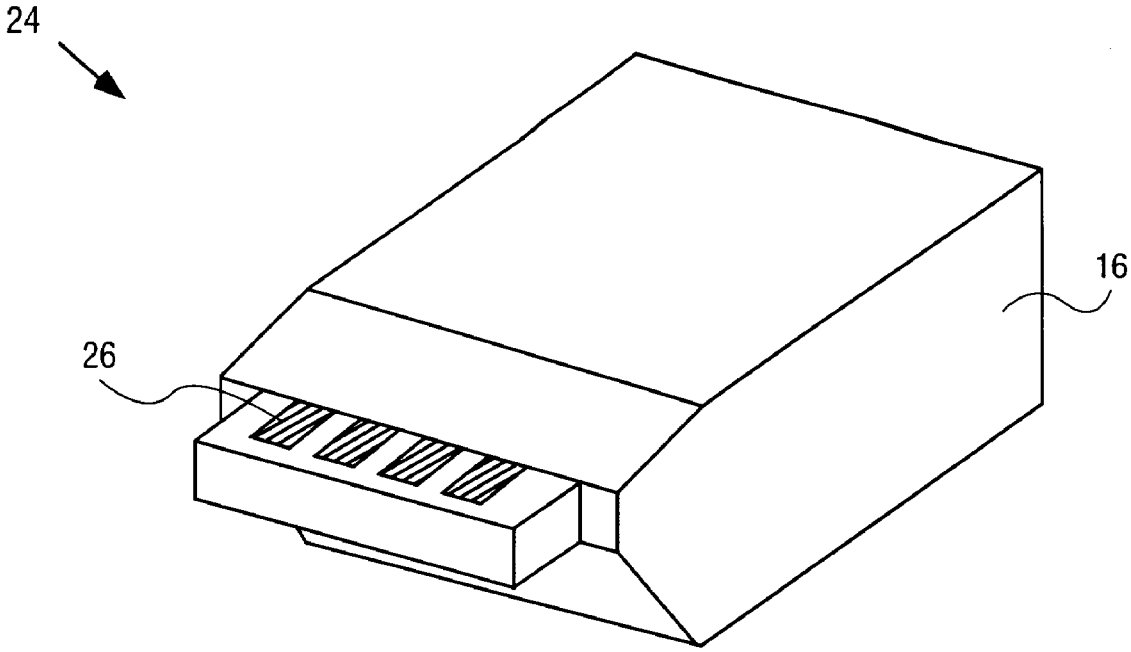
FIG. 3A is a pictorial illustration of the IC card of FIG. 2B
Figure 3B:
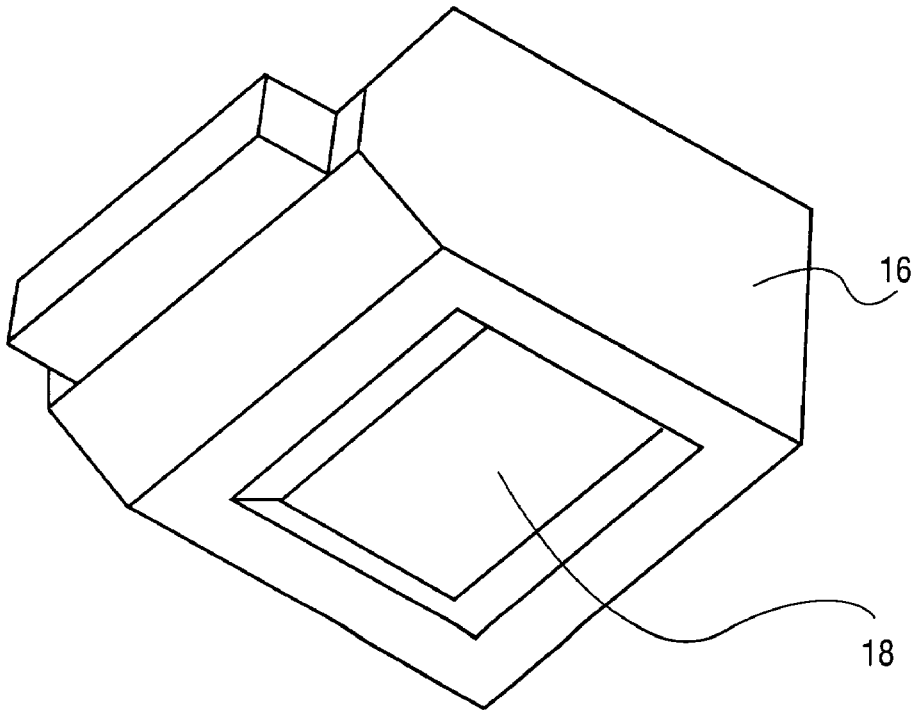
FIG. 3B is a pictorial illustration of the lower side of the IC card of FIG. 3A
Figure 4:
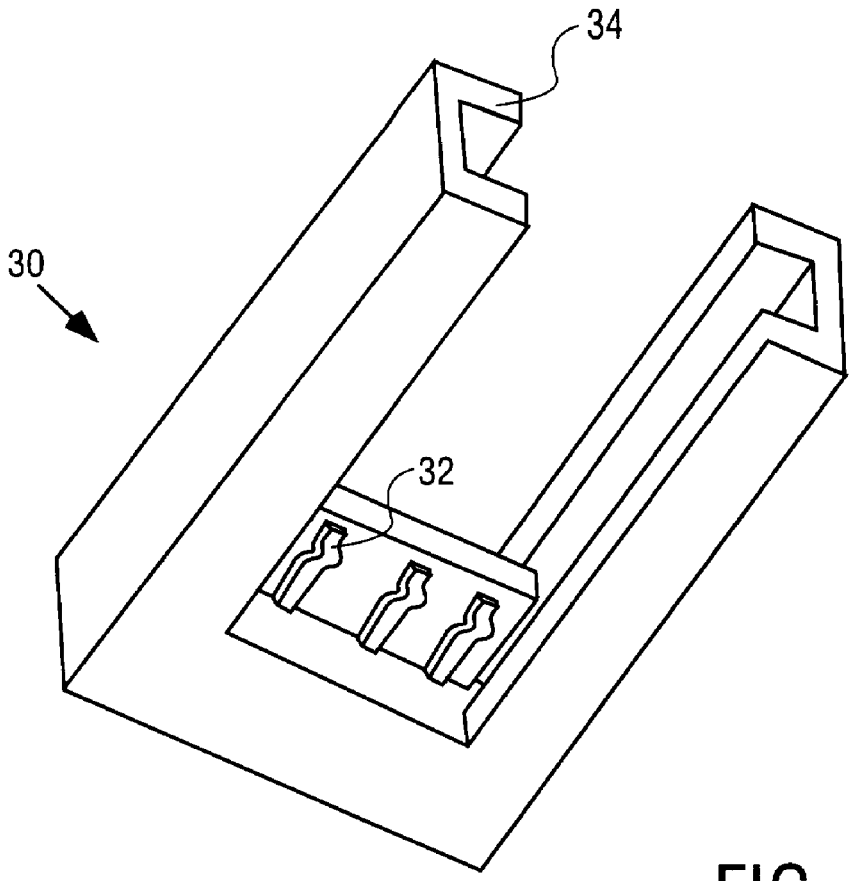
FIG. 4 is a pictorial illustration of the host socket corresponding to the IC card of FIG. 3A.

FIGS. 3A and 3B are pictorial illustrations of the IC card 24 comprising the casing 16 with the IC package 10 fully inserted therein. FIG. 4 is a pictorial illustration of a bottom view of the receptacle of the data processing system (or host socket) into which the IC card 24 may be inserted. The card 24 is inserted into the receptacle 30 along the guide arms 34. The contacts 32 of the receptacle 30 are spring-loaded to allow contact with the IC card connector contacts 22 at surface 26 on the IC card 24 once the card 24 is inserted into the host socket 30. Thus, the electrical interface between the IC package 10 and the host socket 30 is established without the use of a PCB. Consequently, the prior art's need for a soldering step connecting the IC package to the PCB and connector is also eliminated.

Figure 5:
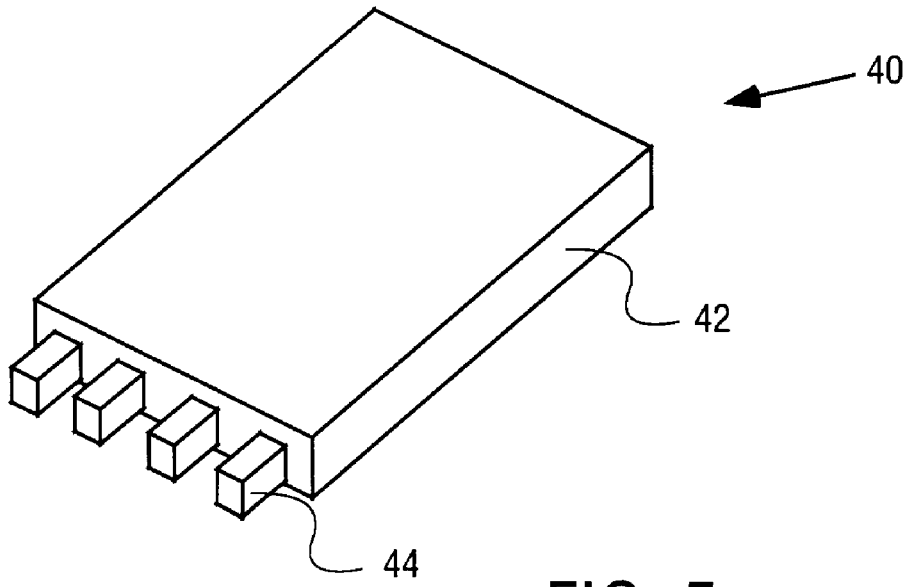
FIG. 5 is a pictorial illustration of an integrated circuit (IC) package with lead pins extending from the IC package.

FIG. 5 is a pictorial illustration of an IC package 40 with lead pins 44 extending from the IC package. The IC package 40 is comprised of an IC die encased within housing 42. The IC die is mounted on a lead frame having multiple lead pins 44 extending from the housing 42. The lead pins 44 are coupled internally to the IC die leads and extend from the housing 40 to allow the now protected IC die to coupled to and communicate with other devices. The IC package 40 is a typical IC package for use with a second embodiment of the present invention.

Figure 6A:
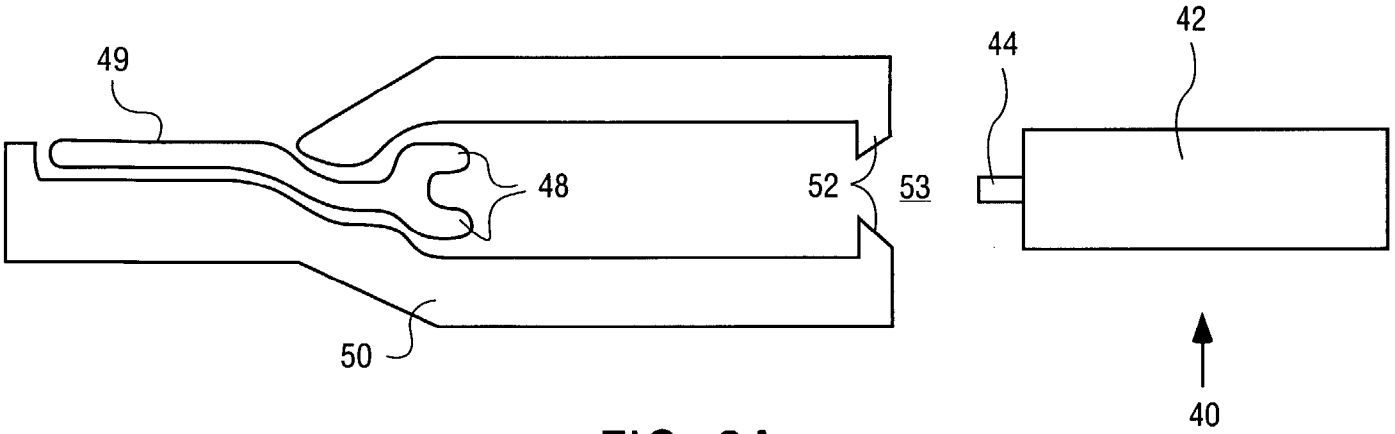
FIG. 6A is a side view of a casing for housing an IC package to form an IC card such that once the IC package is inserted into the casing, the leads from the IC package serve as the electrical interface between the IC card connector and the IC package without the need for a printed circuit board.
Figure 6B:
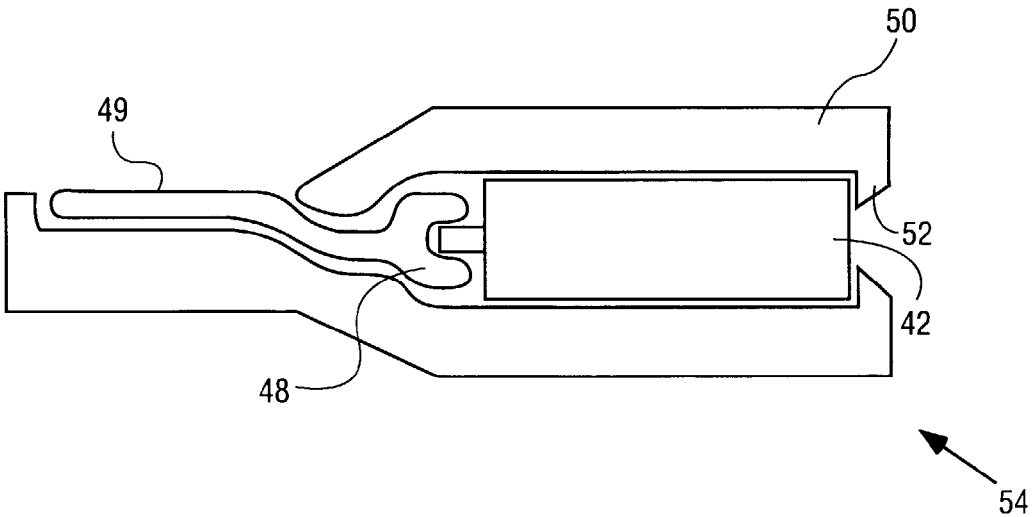
FIG. 6B is a side view of the assembled IC card of FIG. 6A.

FIGS. 6A and 6B are side views of a second embodiment of the present invention showing a casing for housing an IC package to form an IC card such that once the IC package is inserted into the casing, the leads from the IC package serve as the electrical interface between the IC card connector and the IC package without the need for a PCB.

The IC package 40 (see FIG. 5) is inserted into the casing 50 through the back opening 53. The stops 52 will encounter the front corners of the housing 42 of the IC package 40. However, as the IC package 40 is inserted into the casing 50, the casing 50 will slightly expand and allow the IC package 40 to be inserted past the stops 52. The IC package 40 is inserted into the casing 50 such that the leads 44 are in contact with the card connector 48. Once the IC package 40 is fully inserted into the casing 50, the stops 52 will lower back into position and hold the IC package 40 securely within the casing 50. The stops 52 function as snap locks to hold the IC package 40 in place within the casing 50.

Figure 7A:
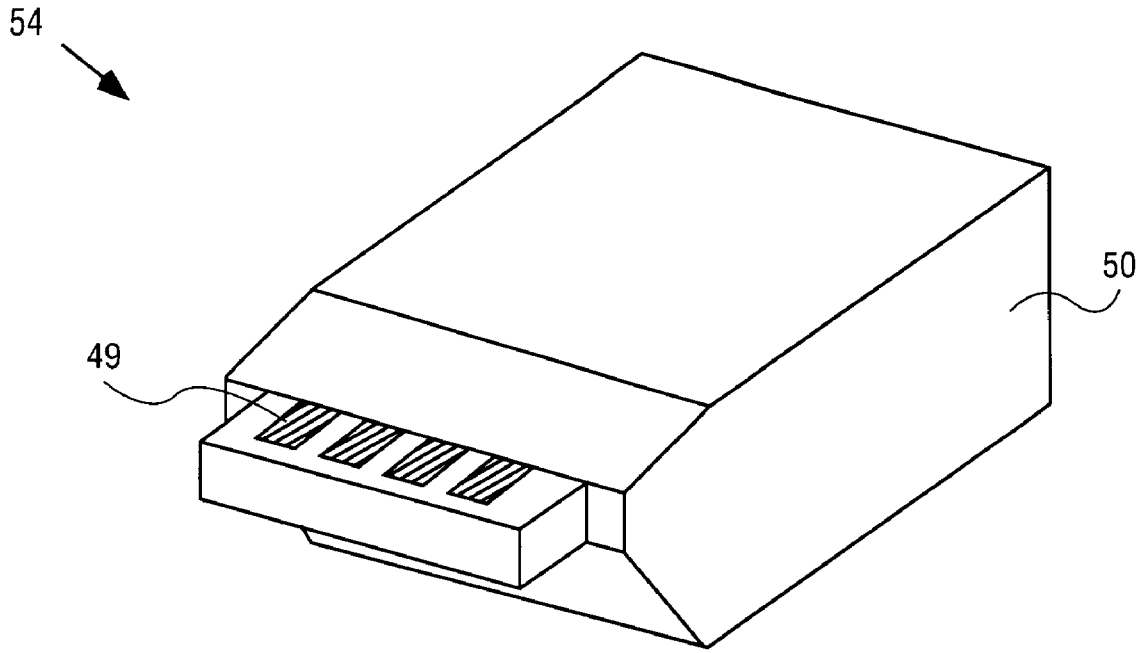
FIG. 7A is a pictorial illustration of the IC card of FIG. 6B.
Figure 7B:
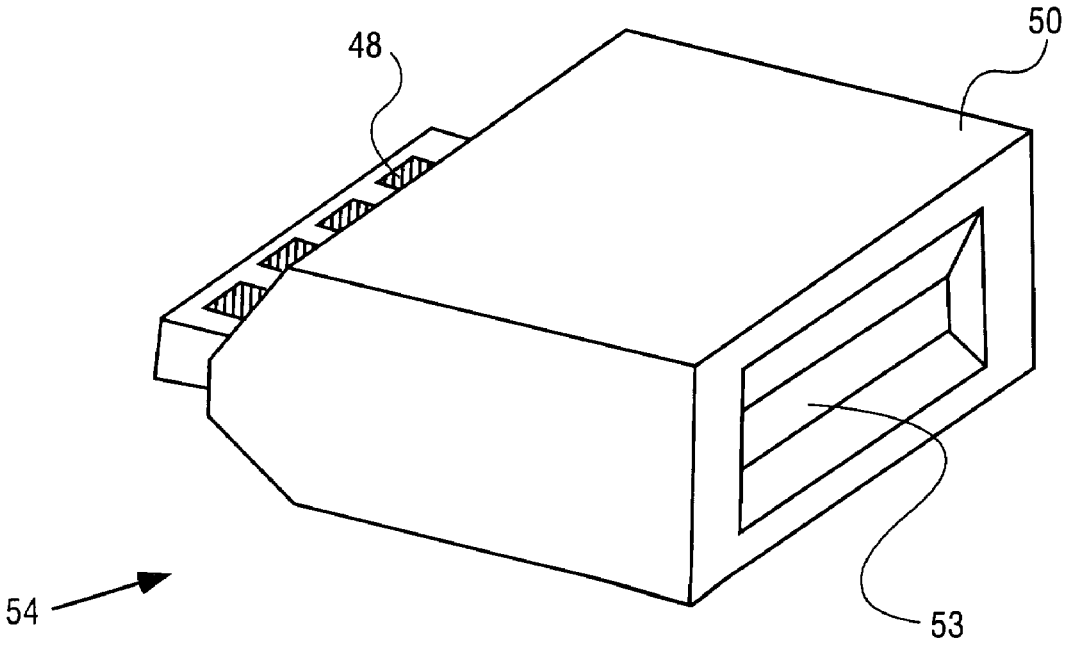
FIG. 7B is a pictorial illustration of a back view of the IC card of FIG. 6B.

Once the IC package 40 is inserted into the card casing 50, the connector contacts 48 provide the electrical interface of the IC card 54 with the data processing system along surface 49. As the IC package 40 is inserted into the casing 50, the leads 44 will encounter the contacts 48. FIG. 6B is a side view of the IC card 54 comprising the casing 50 with the IC package 40 fully inserted therein, and FIGS. 7A and 7B are pictorial illustrations of the assembled IC card 54 shown in FIG. 6B.

The IC card 54 described in this second embodiment may be inserted into a host socket such as the one shown in FIG. 4. As in the first embodiment, the IC card 54 is inserted into the host socket 30 along the guide rails 34. The host socket contacts 32 make contact with the IC card connector contacts 48 along surface 49. Note that the host socket contacts 32 are spring-loaded to allow for IC card 54 casing/connector dimensional tolerances and to ensure contact with the card connector at surface 49. Thus, the electrical interface between the IC package 40 and the host socket 30 is established without the use of a PCB. Consequently, the prior art's need for a soldering step of coupling the IC package to the PCB and connector is eliminated.

Figure 8A:
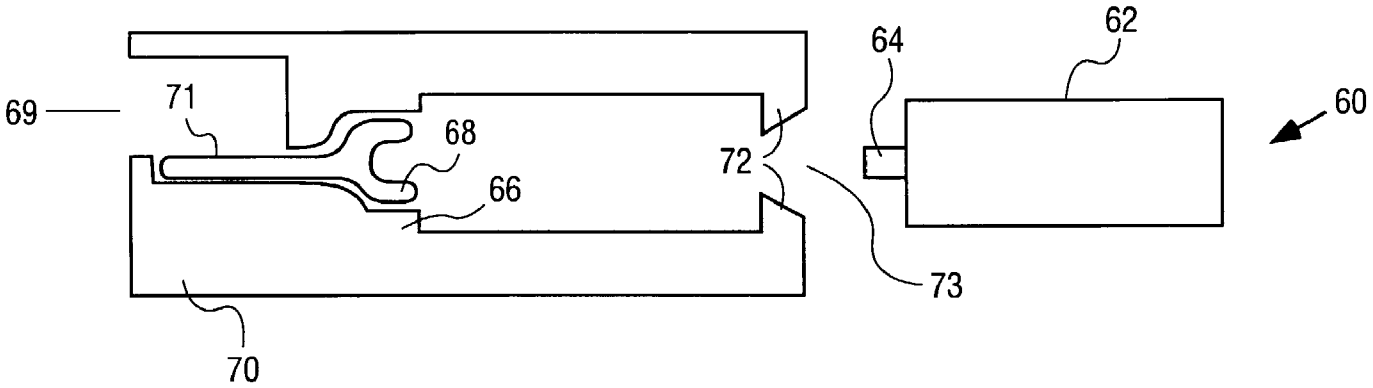
FIG. 8A is a side view of a casing for housing an IC package to form an IC card such that once the IC package is inserted into the casing, the leads from the IC package serve as the electrical interface between the IC card connector and the IC package without the need for a printed circuit board.
Figure 8B:
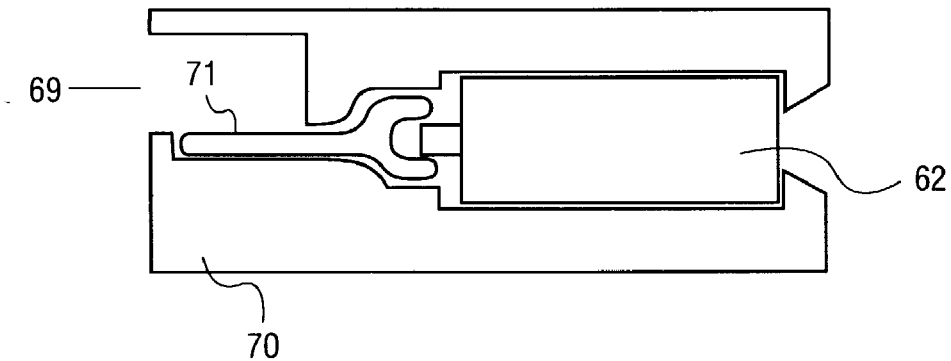
FIG. 8B is a side view of the assembled card of FIG. 8A.

A third embodiment of the present invention is illustrated in FIGS. 8A and 8B. FIGS. 8A and 8B are side views of a casing for housing an IC package to form an IC card such that once the IC package is inserted into the casing, the leads from the IC package serve as the electrical interface between the IC card connector and the IC package without the need for a PCB. Note that the third embodiment is very similar to the above-described second embodiment, but provides a slightly different interface between the IC card connector and the receptacle of the host data processing system.

The IC package 60 (same as IC package 40 shown in FIG. 5) is inserted into the casing 70 through the back opening 73. The stops 72 will encounter the front corners of the housing 62 of the IC package 60. However, as the IC package 60 is inserted into the casing 70, the casing 70 will slightly expand and allow the IC package 60 to be inserted past the stops 72. The IC package 60 is inserted into the casing 70 until the front edge of the housing 62 rests against the inner edges 66 of the casing 70 and the leads 44 are in contact with the connector 68. Once the IC package 60 is fully inserted into the casing 70, the stops 72 will lower back into position and hold the IC package 60 securely within the casing 70. The stops 72 function as snap locks to hold the IC package 60 in place within the casing 70.

Figure 9:
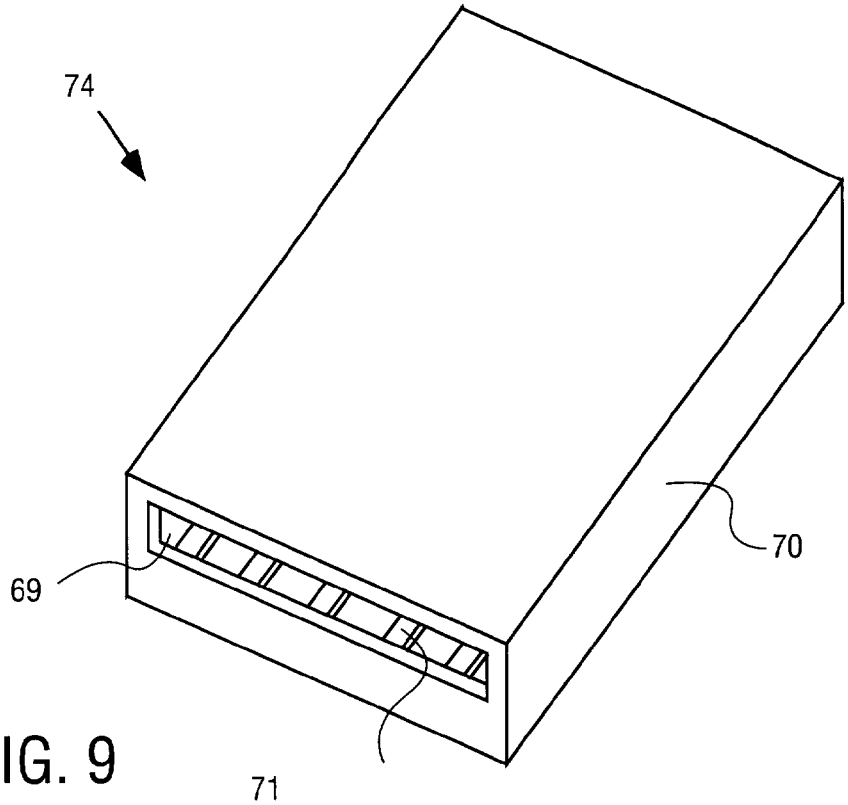
FIG. 9 is a pictorial illustration of the assembled card of FIG. 8B.

Once the IC package 60 is inserted into the card casing 70, the connector contacts 68 provide the electrical interface of the IC card 74 with the data processing system along surface 71. As the IC package 60 is inserted into the casing 70, the leads 64 will encounter the contacts 68. FIG. 8B is a side view of the IC card 74 comprising the casing 70 with the IC package 60 fully inserted therein, and FIG. 9 is a pictorial illustration of the assembled card shown in FIG. 8B.

Figure 10:
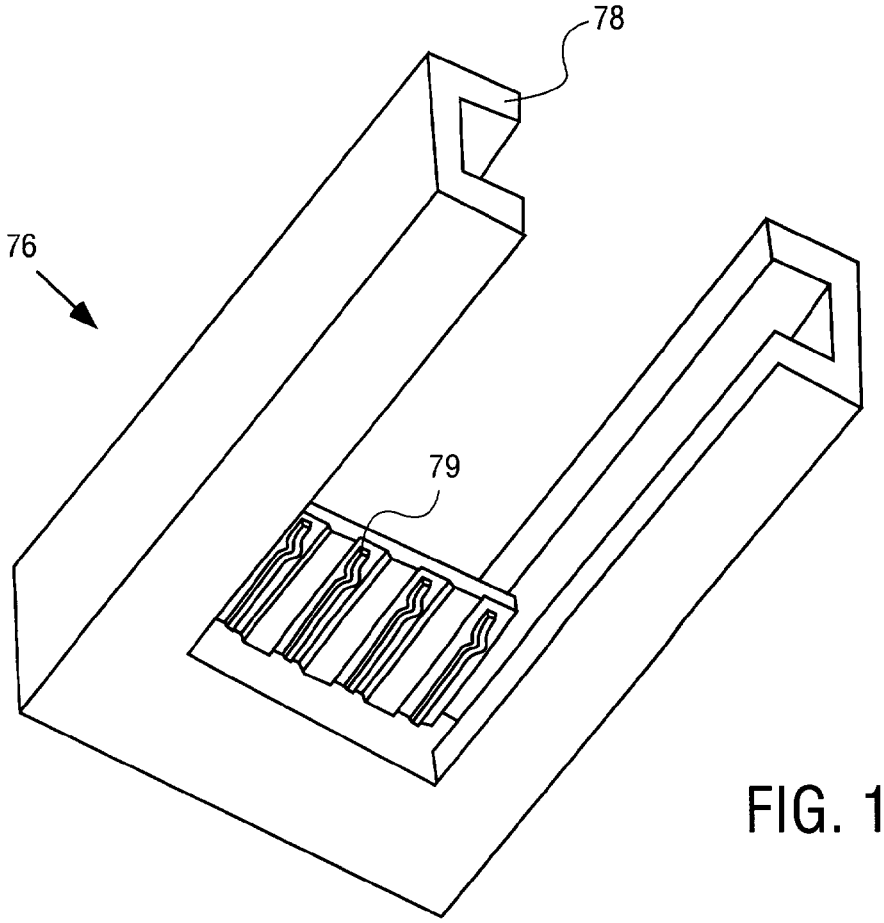
FIG. 10 is a pictorial illustration of a bottom view of a host socket corresponding to the IC card of FIG. 9

The IC card 74 may be inserted into a host socket 76 such as the one shown in FIG. 10. As in the first two embodiments, the IC card 74 is inserted into the host socket 76 along the guide rails 78. The host socket contacts 79 mate with the IC card 74 through the front opening 69 and then make contact with the IC card connector 68 along surface 71. Note that the host socket contacts 79 are spring-loaded to allow for IC card 74 casing/connector dimensional tolerances and to ensure contact with the card connector at surface 71. Thus, the electrical interface between the IC package 60 and the host socket 76 is established without the use of a PCB. Consequently, the prior art's need for a soldering step of coupling the IC package to the PCB and connector is eliminated.

Figure 11:
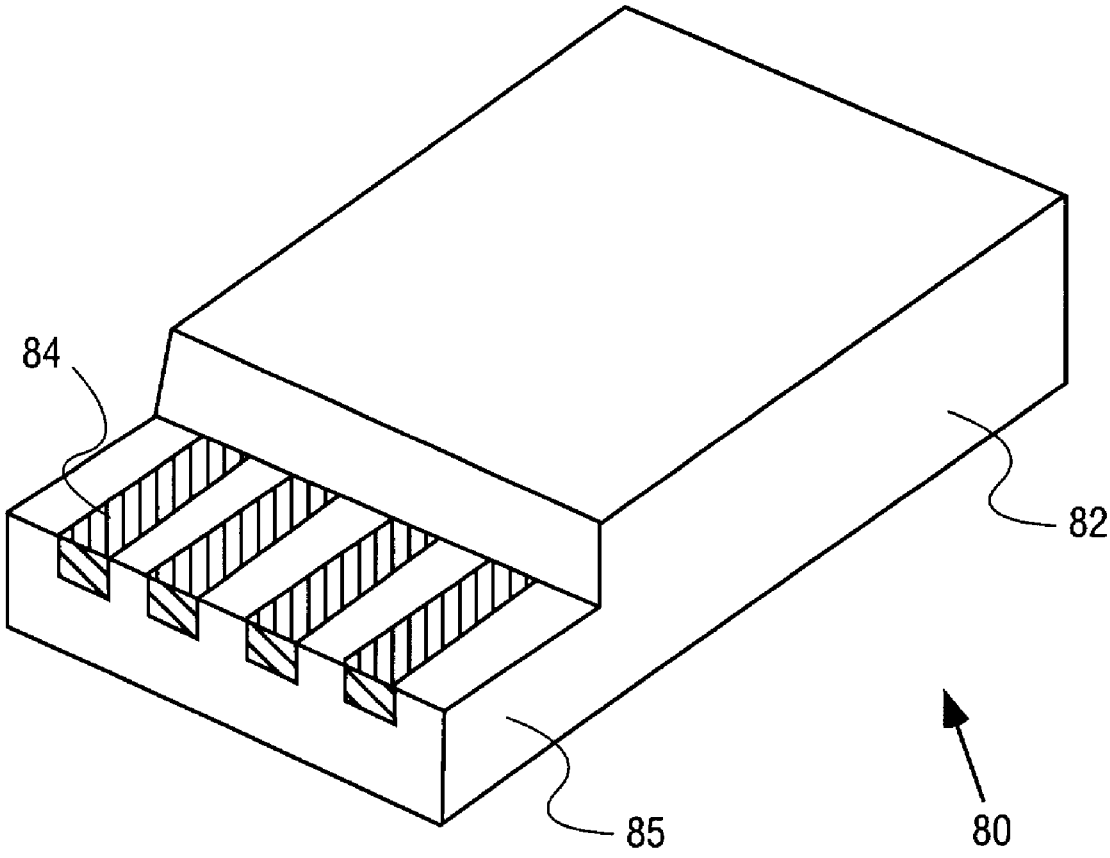
FIG. 11 is a pictorial illustration of an IC package in which the leads are supported and function as a blade on pad connection.

A fourth embodiment of the present invention is described as used with a blade on pad IC package, such as the one shown in FIG. 11. In the IC package 80, an IC die is encased within the housing 82 and leads 84 are internally coupled to the IC die and extend from the housing 82 to allow the IC die to be coupled to and communicate with other devices. This IC package 80 has what is typically referred to as blade-on-pad leads. A blade-on-pad IC package is one in which the leads 84 are supported by a support 85 of the housing 82. The leads 84 are flush with the upper surface of the support 85.

Figure 12A:
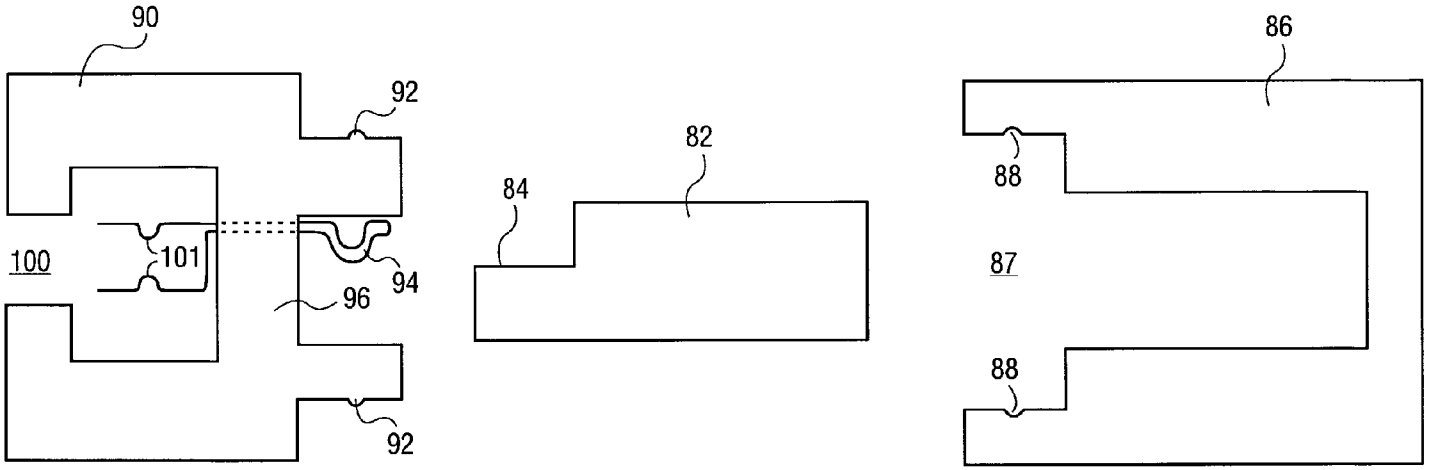
FIG. 12A is a side view of a casing for an IC package that couples to a connector to form an IC card allowing the leads from the IC package to serve as the electrical interface between the IC card connector and the IC package without the need for a printed circuit board.
Figure 12B:
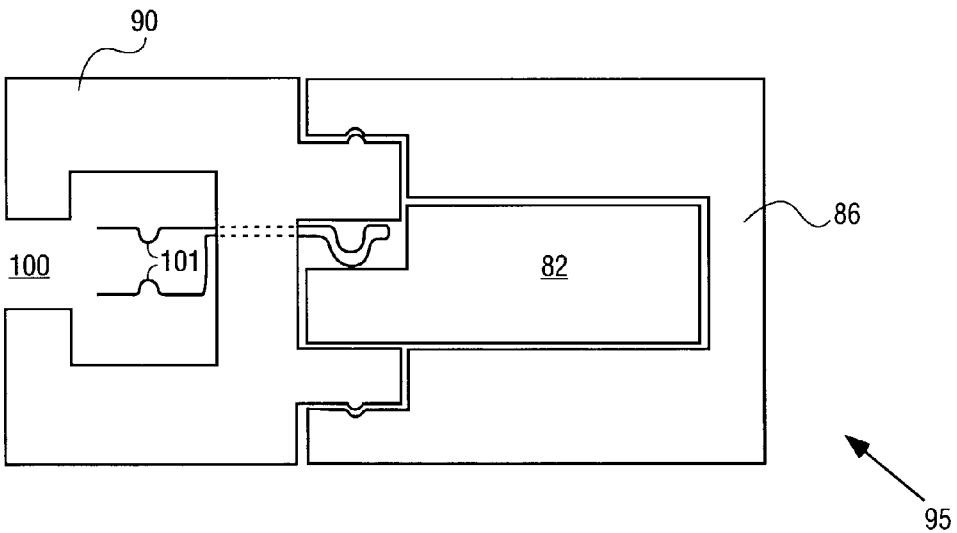
FIG. 12B is a side view of the assembled card of FIG. 11.
Figure 13A:
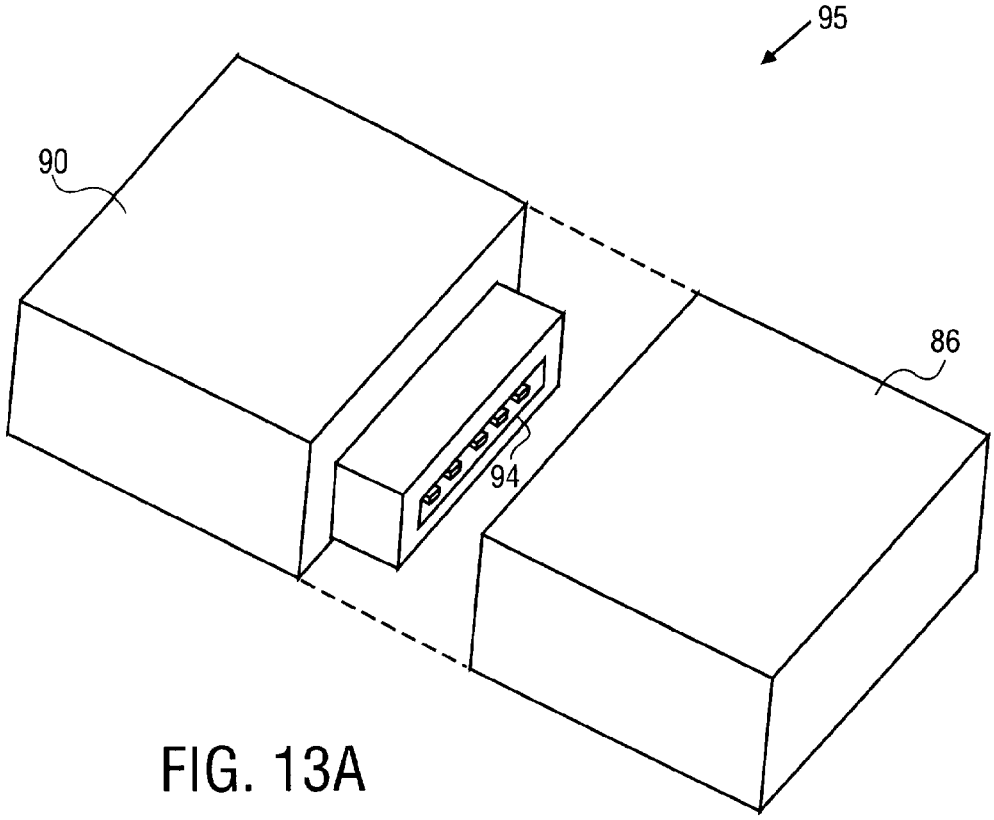
FIG. 13A is a pictorial illustration of the disassembled IC card of FIG. 12B.
Figure 13B:
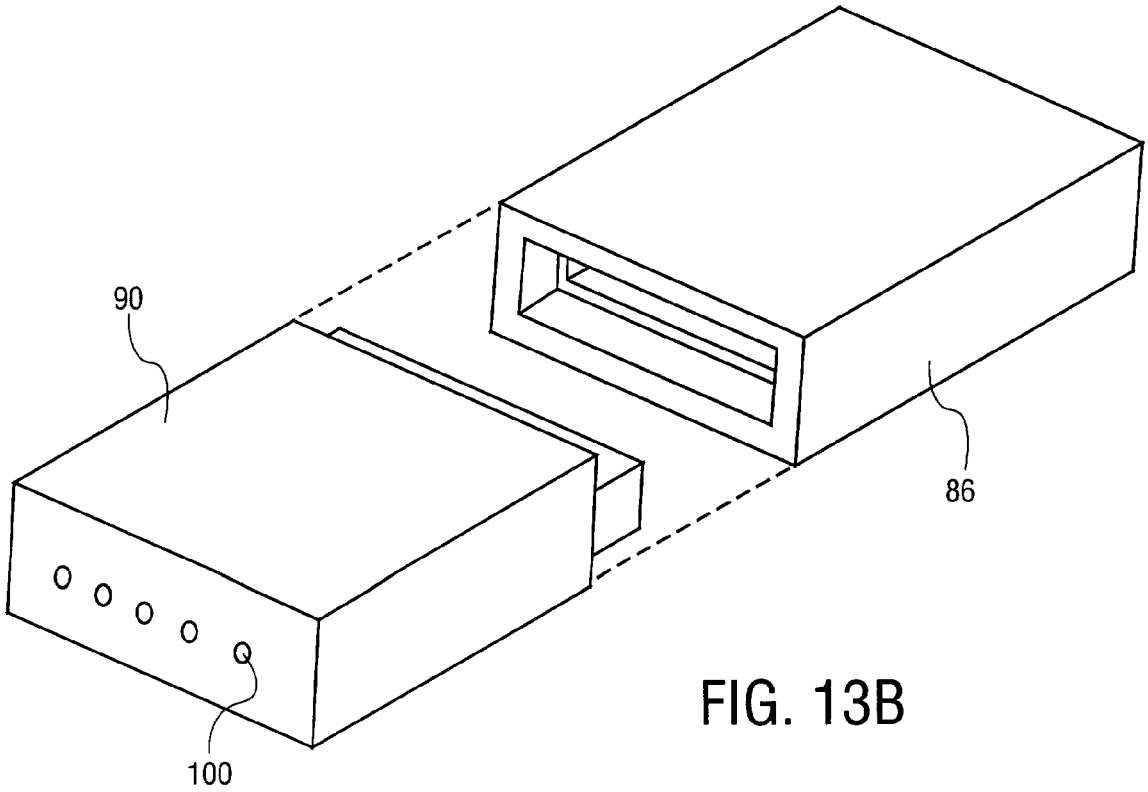
FIG. 13B is a pictorial illustration of the disassembled IC card of FIG. 12B.

FIGS. 12A and 12B are side views of the fourth embodiment of the present invention. Unlike the previously described embodiments, in the fourth embodiment the casing and card connector are two separate pieces. The casing and connector then couple together to encase an IC package and form an IC card, wherein the leads from the IC package serve as the electrical interface between the IC card connector and the IC package without the need for a PCB. A pictorial illustration of the casing 86 and connector 90 is shown in FIGS. 13A and 13B.

The preferred method of assembly of IC card 95 begins with coupling the IC package 82 and the card connector 90. The IC package 82 is inserted into card connector 90 until the front edge of the IC package 80 rests against the inner wall 96 of the connector 90. The leads 84 are then in contact with the connector contacts 94. Thus, the leads 84 of the IC package 82 provide the electrical interface between the IC package 80 and the card connector 90.

The casing 86 is then coupled to the card connector 90 such that the IC package 80 is securely housed within the coupled components 90 and 86. One method of coupling the casing 86 to the card connector 90 uses snap locks. As the stops 92 on the connector 90 encounter the front edge of the casing 86, the connector 90 will be slightly depressed and the casing 86 will be slightly expanded to allow the connector 90 to continue being inserted into the casing 86. Once the connector 90 is fully inserted into the casing 86, the stops 92 will reside in the indention 88, and the connector 90 and casing 86 will be securely coupled together. Note that although stop 92 is shown as a button residing in indention 88, other arrangements of button/indention combinations or other similar stop concepts may be used to couple the connector 90 to the casing 86.

Figure 14:
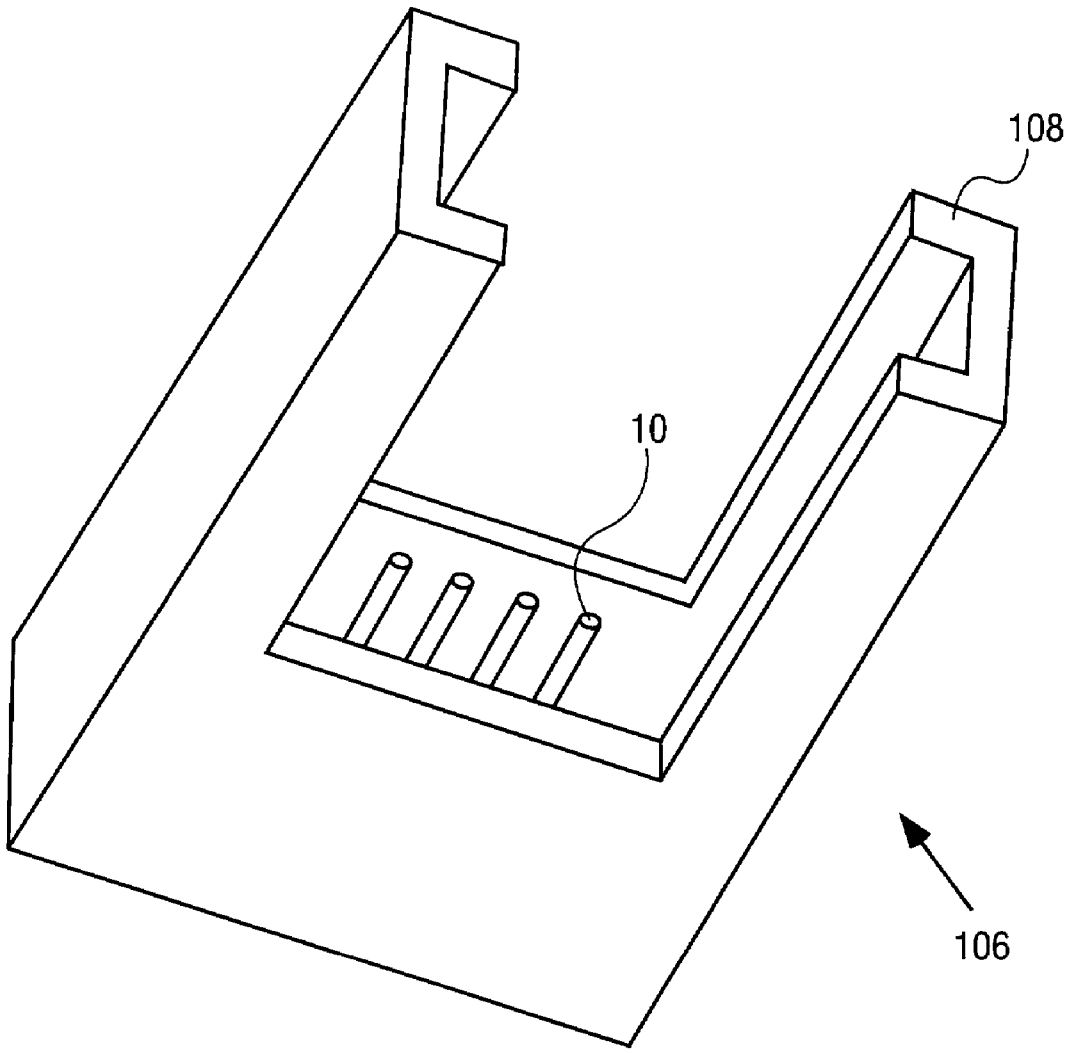
FIG. 14 is pictorial illustration of a bottom view of the host socket that corresponds to the IC card of FIGS. 12 and 13.

The IC card 95 may then be inserted into a host socket 106 such as the one shown in FIG. 14. As in the above described embodiments, the IC card 95 is inserted into the host socket 106 along the guide rails 108. The host socket contact pins 110 mate with the IC card 95 through the front openings 100 and then make contact with the IC card connector contacts 94 at points 101. IC card 95 has pin and socket style contacts similar to those of the PCMCIA card connector. The card connector contacts 94 are spring-loaded at point 101 to allow a variation in the exact position and dimensional tolerances of the inserted host socket contact pins 110 and to ensure contact between the pins 110 and the contacts 94. Thus, the electrical interface between the IC package 80 and the host socket 106 is established without the use of a PCB. Consequently, the prior art's need for a soldering step of coupling the IC package to the PCB and connector is eliminated.

In each of the above embodiments, the housing of the IC package is a plastic (organic resin) overmold with the IC die mounted directly onto the lead frame within the housing. The casing into which the IC package is inserted is a preferably a piece of plastic formed from injection molding. As with current form factor cards, the dimensions of the casing of the present invention may be defined by both the size and shape of the IC package that is housed within the casing and/or the dimensions of the receptacle of the host data processing system into which the IC card is inserted. Although several specific casing designs have been discussed, the present invention is not limited to the embodiments described herein. Rather, any one of numerous casing designs may be used as long as the IC package leads can contact the card connector without the use of a PCB.

The connector contacts and IC package leads serving as the electrical interfaces within the IC card are made according to industry standards, typically of beryllium copper, plated copper, etc. Further, because the exact size and position of the connector contacts and IC package leads within the card casing may vary, it is preferred that both the contacts on the receptacle of the data processing system and the card connector contacts are spring mounted to ensure the electrical interface is complete.

Thus, the present invention describes an IC card that eliminates the PCB entirely by allowing the leads from the IC package to serve as the electrical interface between the IC package and the card connector, which is now independent of the PCB. Because a PCB is no longer required to make the connection between the IC package and the data processing system, the manufacturing step of soldering the IC package on to the PCB is eliminated. By eliminating the need for soldering the IC package to the PCB, less material will be used and fewer leads will be damaged. Consequently, the reliability of the IC card will increase and the time required to assemble the IC card will decrease.

We claim:

1. An integrated circuit (IC) card for use in a data processing device, comprising:

an IC package having multiple leads extending from said IC package;

a casing that encases said IC package; and a connector contact residing within said casing, said connector contact providing an electrical interface between said IC package and said data processing device, such that if said IC package is inserted into said casing said multiple leads contact said connector contact without use of a printed circuit board, wherein said casing includes an upper surface with an upper opening and a back surface with a back opening, wherein said IC package is inserted into said casing through said back opening, and said connector contact provides electrical interface with said data processing device through said upper opening, and wherein said casing includes at least one stop positioned between said upper surface and said back surface such that said stop allows said IC package to be fully inserted into said casing, and said stop holds said IC package securely within said casing.

2. A casing for an integrated circuit card, comprising:

a housing for encasing an integrated circuit having multiple leads extending from said integrated circuit; and a connector contact residing within said housing, such that if said casing is inserted into a receptacle of a data processing device said connector contact contacts said multiple leads extending from said integrated circuit and provides an electrical interface between said integrated circuit and said data processing device without use of a printed circuit board, wherein said housing includes an upper surface with an upper opening and a back surface with a back opening, such that when said integrated circuit is inserted into said housing through said back opening, said connector contact provides electrical interface with said data processing device through said upper opening, and wherein said housing includes at least one stop positioned between said upper surface and said back surface such that said stop allows said IC package to be fully inserted into said casing, and said stop holds said IC package securely within said casing.

3. A method of assembling an integrated circuit (IC) card for use in a data processing device, the method comprising:

providing an IC package having multiple leads extending from said IC package;

providing a casing having a connector contact residing therein, said connector contact providing an electrical interface between said IC package and said data processing device, said providing the casing including:

providing the casing having an upper surface with an upper opening and a back surface with a back opening, and said step of inserting said IC package includes inserting said IC package into said casing through said back opening, and providing the casing having at least one stop positioned between said upper surface and said back surface such that if said IC package is fully inserted into said casing, said stop holds said IC package securely within said casing; and inserting said IC package into said casing such that said multiple leads contact said connector contact without use of a printed circuit board.

* * * * *